US010316655B2

(12) United States Patent
Zuo et al.

(10) Patent No.: US 10,316,655 B2
(45) Date of Patent: Jun. 11, 2019

(54) METHOD AND APPARATUS FOR CONSISTENT AND ROBUST FITTING IN OIL BASED MUD FILTRATE CONTAMINATION MONITORING FROM MULTIPLE DOWNHOLE SENSORS

(71) Applicant: Schlumberger Technology Corporation, Sugar Land, TX (US)

(72) Inventors: Youxiang Zuo, Sugar Land, TX (US); Adriaan Gisolf, Houston, TX (US); Ryan Lee, Sugar Land, TX (US); Cosan Ayan, Istanbul (TR); Hadrien Dumont, Houston, TX (US); Kang Wang, Beijing (CN); Chetankumar Desai, Sugar Land, TX (US); Oliver Mullins, Houston, TX (US); Beatriz Barbosa, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 517 days.

(21) Appl. No.: 14/085,589

(22) Filed: Nov. 20, 2013

(65) Prior Publication Data

US 2015/0142317 A1 May 21, 2015

(51) Int. Cl.
*E21B 49/08* (2006.01)

(52) U.S. Cl.
CPC ..... *E21B 49/088* (2013.01)

(58) Field of Classification Search
CPC ..... E21B 49/088
USPC ..... 702/6
See application file for complete search history.

(56) References Cited

U.S. PATENT DOCUMENTS

| | | | | |
|---|---|---|---|---|
| 4,454,756 | A * | 6/1984 | Sharp | E21B 47/022 33/313 |
| 6,274,865 | B1 * | 8/2001 | Schroer | E21B 47/102 250/255 |
| 6,350,986 | B1 * | 2/2002 | Mullins | E21B 47/102 250/255 |
| 6,956,204 | B2 | 10/2005 | Dong et al. | |
| 8,024,125 | B2 | 9/2011 | Hsu et al. | |
| 9,733,389 | B2 | 8/2017 | Hsu et al. | |
| 2003/0229448 | A1 * | 12/2003 | Storm, Jr. | G01N 33/2823 702/6 |
| 2004/0193375 | A1 * | 9/2004 | Dong | E21B 47/10 702/13 |
| 2005/0182566 | A1 | 8/2005 | DiFoggio | |
| 2008/0156088 | A1 * | 7/2008 | Hsu | E21B 49/10 73/152.23 |
| 2010/0169020 | A1 * | 7/2010 | Niu | E21B 49/008 702/13 |

* cited by examiner

*Primary Examiner* — Manuel L Barbee
*Assistant Examiner* — Raymond L Nimox
(74) *Attorney, Agent, or Firm* — Michael Dae

(57) ABSTRACT

A method for performing contamination monitoring through estimation wherein measured data for optical density, gas to oil ratio, mass density and composition of fluid components are used to obtain plotting data and the plotting data is extrapolated to obtain contamination levels.

9 Claims, 5 Drawing Sheets

METHOD AND APPARATUS FOR CONSISTENT AND ROBUST FITTING IN OIL BASED MUD FILTRATE CONTAMINATION MONITORING FROM MULTIPLE DOWNHOLE SENSORS

CROSS-REFERENCE TO RELATED APPLICATIONS

None.

FIELD OF THE INVENTION

Aspects of the disclosure relate to downhole fluid monitoring. More specifically, aspects of the disclosure relate to a method and apparatus for consistent oil based mud filtrate contamination monitoring using multiple downhole sensors.

BACKGROUND INFORMATION

Downhole sampling is often performed during geological investigation. Downhole sampling allows operators and engineers the opportunity to evaluate subsurface conditions in order to optimize wellbore placement and completion operations. As a matter of example, successful downhole sampling can help pinpoint hydrocarbon bearing stratum and maximize chances of a successful drilling operation.

Many factors can adversely affect successful downhole sampling. Contamination from various sources can mislead operators as to the geological formations that are being investigated. The contaminants can come from many places, such as downhole stratum, as a non-limiting embodiment.

To assist in downhole sampling, many different sensors are used to measure different parameters of downhole fluids. To date, no single method allows for optimization of such sensor readings as different analyses are used and such analyses have various arbitrary analyses.

SUMMARY

The summary herein, should not be considered to limit the aspects described and claimed. In one non-limiting embodiment, a method for contamination monitoring is provided entailing measuring data of an optical density, GOR, mass density, composition of at least two components and one of a pumpout volume and a pumpout time at a downhole location, determining linear relationships among the measured data for optical density, GOR, mass density and the composition of the at least two components, selecting a fitting interval of one of pumpout volume and pumpout time, normalizing the measured data, determining a cleanup exponent in a flow model by fitting the normalized GOR data, obtaining a plot of data by fitting the individual cleanup data at a fixed obtained exponent; estimating fluid properties for optical density, mass density, GOR and composition for native oil by extrapolating the pumpout volume to infinity for the plot of data, estimating fluid properties for optical density, mass density, GOR and composition for pure OBM filtrate by extrapolating GOR to zero for the plot of data and estimating an OBM filtrate contamination level.

DETAILED DESCRIPTION

Figure 1:
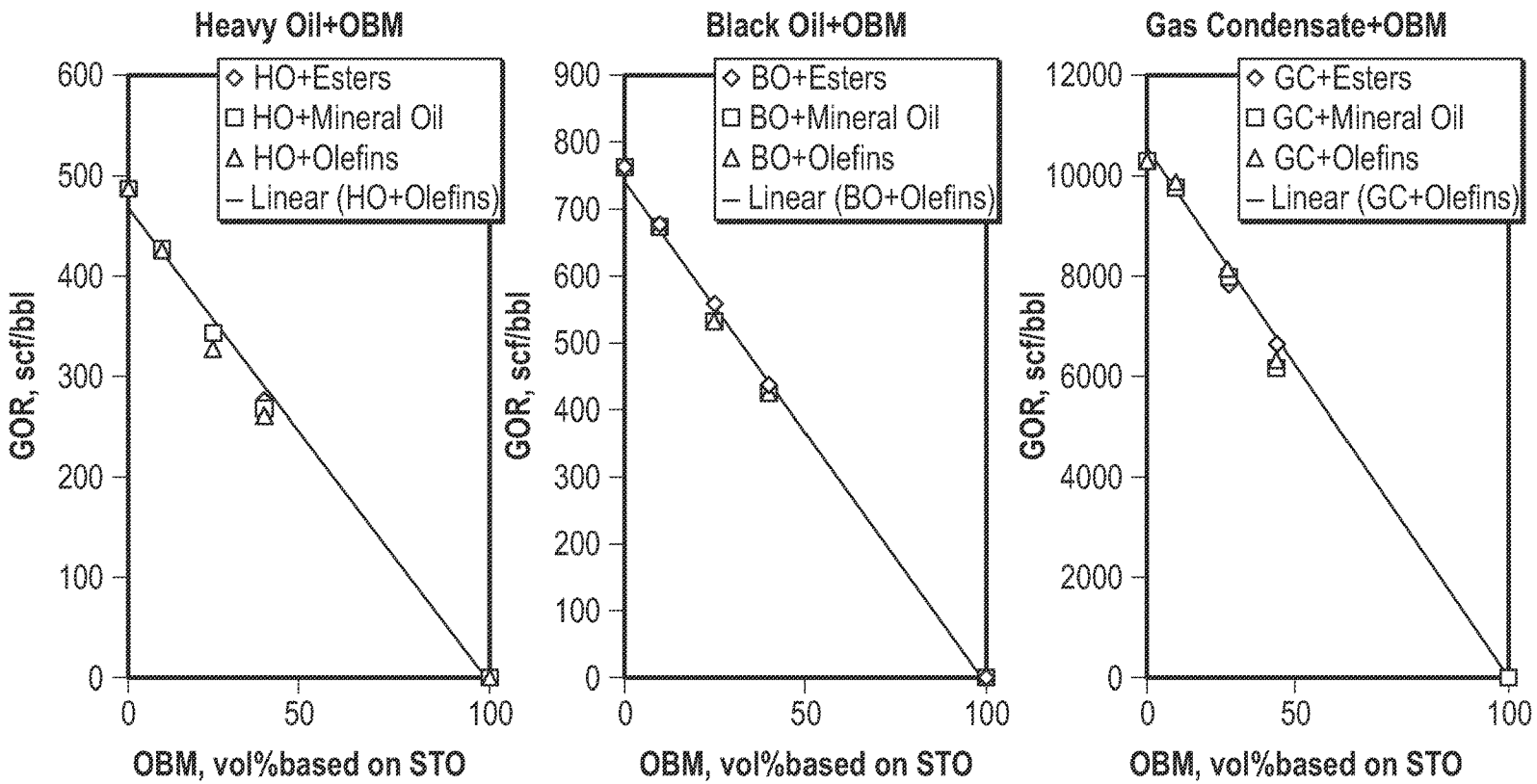
FIG. 1 is a graph of GOR versus $v_{obmSTO}$ for heavy oil+OBM, black oil+OBM and gas condensate+OBM systems.

Reservoir fluids should be sampled as early as possible during the production life of a reservoir. When the reservoir pressure falls below the initial saturation pressure the hydrocarbon phase forms two phases of gas and liquid. The mole ratio of the two phases flowing into the well is not generally equal to that formed in the reservoir. Hence, the collection of a representative sample becomes a highly demanding, and in many cases an impossible task.

Downhole fluid sampling is used to obtain representative fluid samples at downhole conditions. Oil based drilling mud (OBM) filtrate contamination as well as synthetic based mud contamination affects fluid properties in downhole fluid analysis. On the other hand, it is very difficult to obtain fluid samples with zero OBM filtrate contamination. Thus, OBM filtrate contamination monitoring (OCM) is one of the biggest challenges in downhole fluid analysis. Conventional flitting algorithms do not work for all environments for the focused sampling interface modules. The difficulty lies on how to determine two endpoints for pure OBM filtrate and native (OBM filtrate contamination free) fluids.

Downhole fluid analysis uses multiple sensors (optics, downhole microfluidics, and downhole gas chromatograph) to measure different fluid properties at downhole conditions, gas/oil ratio (GOR), optical density, mass density, saturation pressure, viscosity, compressibility, etc. The fluid properties changing with time and/or pumpout volume can be used to obtain the endpoint fluid properties for the native (OBM filtrate contamination free) fluids during cleanup. In the asymptotic fitting method, asymptotic power functions (exponential or other functions) are often used to fit the real time data. A consistent and robust optimization method would assist to reduce arbitrariness in determining the exponent of the power function asymptote. Such a robust optimization method is provided herein.

A novel procedure is provided for consistent and robust determination of the exponent in a power function asymptote, as a non limiting example, in the OCM fitting models by using multiple downhole fluid analysis sensors. This method proves the linear relationships between any pair of downhole fluid analysis measured optical density, mass density, gas to oil ratio and compositions. Therefore the same exponent should be used for fitting optical density, mass density, gas to oil ratio and compositions. This constraint allows operators to determine a consistent and robust exponent value from downhole fluid analysis measured with optical density, mass density, gas to oil ratio and compositions so that more reliable oil based mud filtrate contamination level and uncontaminated (native) fluid properties such as GOR, mass density, optical density, compressibility and compositions can be obtained.

For a native live reservoir hydrocarbon fluid, the single stage flash GOR is defined as the ratio of the volume of the flashed gas that comes out of the live fluid solution, to the volume of the flashed oil (also referred to as stock tank oil, STO) at standard conditions (typically 60 degrees F. and 14.7 psia). Based on the GOR ratio definition, the oil based mud filtrate contamination level in volume fraction in stock tank oil at standard conditions can be expressed as:

$$v_{obmSTO} = \frac{GOR_0 - GOR}{GOR_0} \quad \text{Equation 1}$$

where $GOR_O$ and GOR are the GOR of the native reservoir fluid and contaminated fluid (referring to as apparent GOR). Apparent GOR can be measured by downhole fluid analysis at a series of time during cleanup. The oil based mud filtrate contamination level in volume fraction based on stock tank oil (STO) can be converted to that based on the live fluid at downhole conditions by the following expression (shrinkage factor, b)

$$\begin{aligned} \frac{v_{obmSTO}}{v_{obm}} &= \left(\frac{\rho_{obm}}{\rho_{obmStd}}\right)\left(\frac{\rho_{STOStd}}{\rho}\right)\left(1 + \frac{GOR}{\rho_{STOStd}}\frac{M_{gas}P_{Std}}{RT_{Std}}\right) \\ &= \frac{B_0}{B_{oobm}} \\ &= \frac{1}{b} \end{aligned} \quad \text{Equation 2}$$

where $\rho_{obm}$, $\rho_{obmStd}$, $\rho$, $\rho_{STOStd}$, $M_{gas}$, $P_{Std}$, $T_{Std}$, and R are the density of pure oil based mud filtrate at downhole and standard conditions, the density of contaminated fluid at downhole and standard conditions, the molecular weight of the flashed gas, the pressure and temperature of standard conditions, and the gas constant, respectively. The formation volume factor ($\beta_o$) of the reservoir fluid is defined as the ratio of the volume (V) of the reservoir fluid at reservoir conditions to that of STO ($V_{STOStd}$) at standard conditions.

$$B_o = \frac{V}{V_{STDStd}} = \left(\frac{\rho_{STOStd}}{\rho}\right)\left(1 + \frac{GOR}{\rho_{STOStd}}\frac{M_{gas}P_{Std}}{RT_{Std}}\right) \quad \text{Equation 3}$$

The formation volume factor ($B_{obm}$) of the oil based mud filtrate is expressed as the ratio of the volume ($V_{obm}$) of the pure oil based mud filtrate at reservoir conditions to that ($V_{obmStd}$) at standard conditions:

$$B_{obm} = \frac{V_{obm}}{V_{obmStd}} = \frac{\rho_{obmStd}}{\rho_{obm}} \quad \text{Equation 4}$$

The right side of Equation 2, shrinkage factor (b) can be approximately equal to a constant for the specified fluid, the oil based mud filtrate contamination based on the live fluid can be expressed as:

$$\begin{aligned} v_{obm} &= \frac{B_{obm}}{B_0} v_{obmSTO} \\ &= b v_{obmSTO} \\ &= b\frac{GOR_0 - GOR}{GOR_0} \end{aligned} \quad \text{Equation 5}$$

Figure 2:
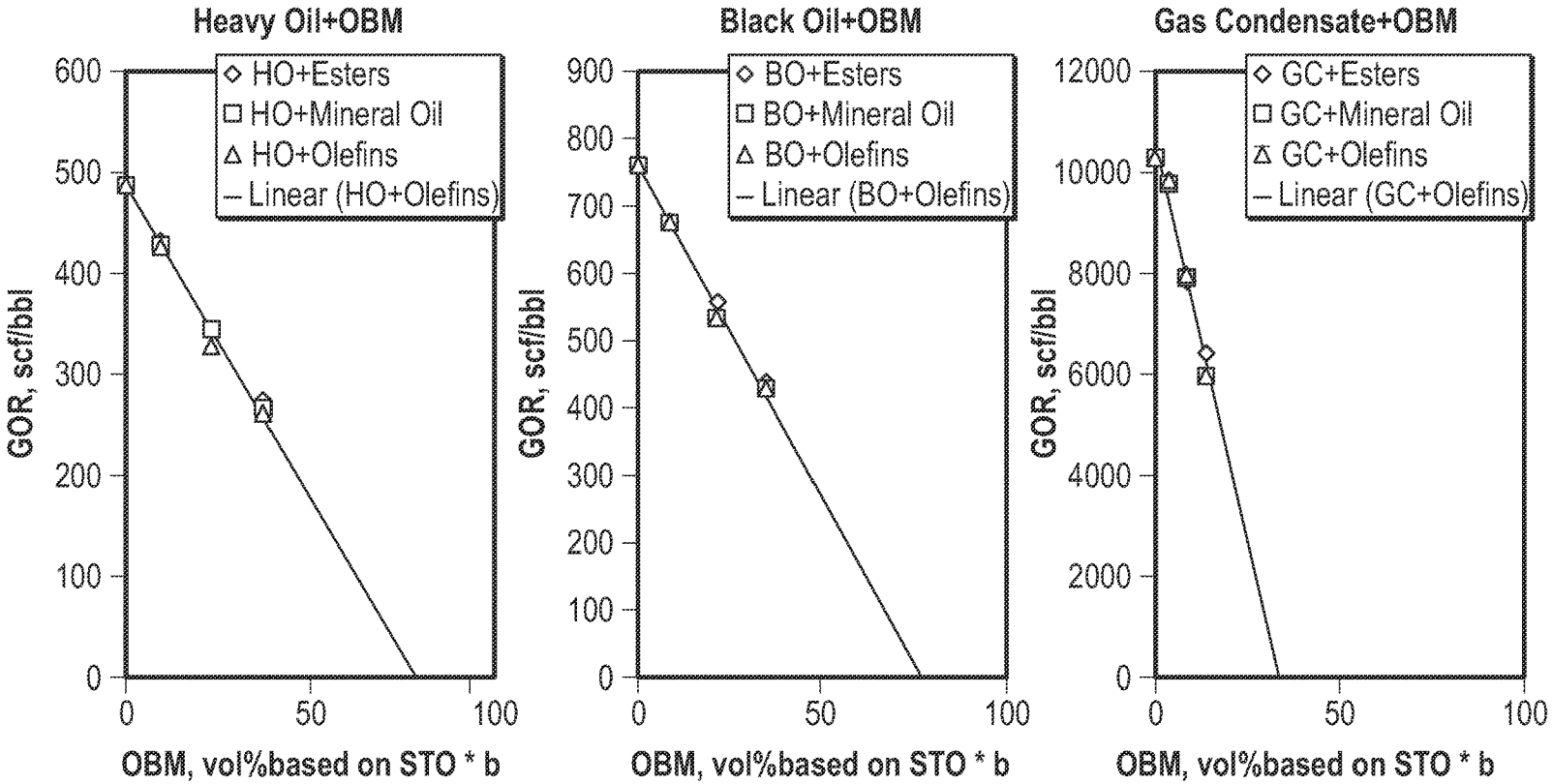
FIG. 2 is a graph of GOR versus $v_{obm}$ for heavy oil+OBM and gas condensate+OBM systems.

FIGS. 1 and 2 show GOR versus $v_{obmSTO}$ (on the STO basis) and GOR versus $v_{obm}$ ($v_{obmSTO}$ converted to the live fluid basis) for heavy oil+oil based mud, black oil plus oil based mud and gas condensate+oil based mud systems from the laboratory data. It can be seen that GOR vs. $v_{obmSTO}$ and GOR versus $v_{obm}$ are all linear. The linear relation between GOR and $v_{obmSTO}$ covers the oil based mud range from $v_{obmSTO}=0$ to $v_{obmSTO}=1$ including two endpoints of the oil based mud (GOR=0 and $v_{obmSTO}=1$) and the native fluid (GOR=$GOR_o$ and $v_{obmSTo}=0$). Whereas the linear relation between GOR and $v_{obm}$ does not pass through the point of $v_{obm}=1$ and GOR=0 instead of $v_{obm}=b$ and GOR=0. Typically, the shrinkage factor $b=B_{obm}/B_0<1$ as shown in FIG. 2.

Referring to FIG. 1, is a graph of GOR versus $v_{obmSTO}$ for heavy oil+OBM, black oil+OBM and gas condensate+OBM systems. The straight lines go through the two endpoints of the native reservoir fluid and pure OBM. All the symbols are laboratory data.

FIG. 2 is a graph of GOR versus $v_{obm}$ for heavy oil+OBM and gas condensate+OBM systems. All the symbols are laboratory data.

The OBM filtrate contamination may be given by mass density $$v_{obm} = \frac{\rho_0 - \rho}{\rho_0 - \rho_{obm}} \quad \text{Equation 6}$$

where $\rho_0$, $\rho$ and $\rho_{obm}$ are the density of the native fluid, contaminated fluid (referred to as apparent density, measured by downhole fluid analysis) and pure OBM filtrate.

Figure 3:
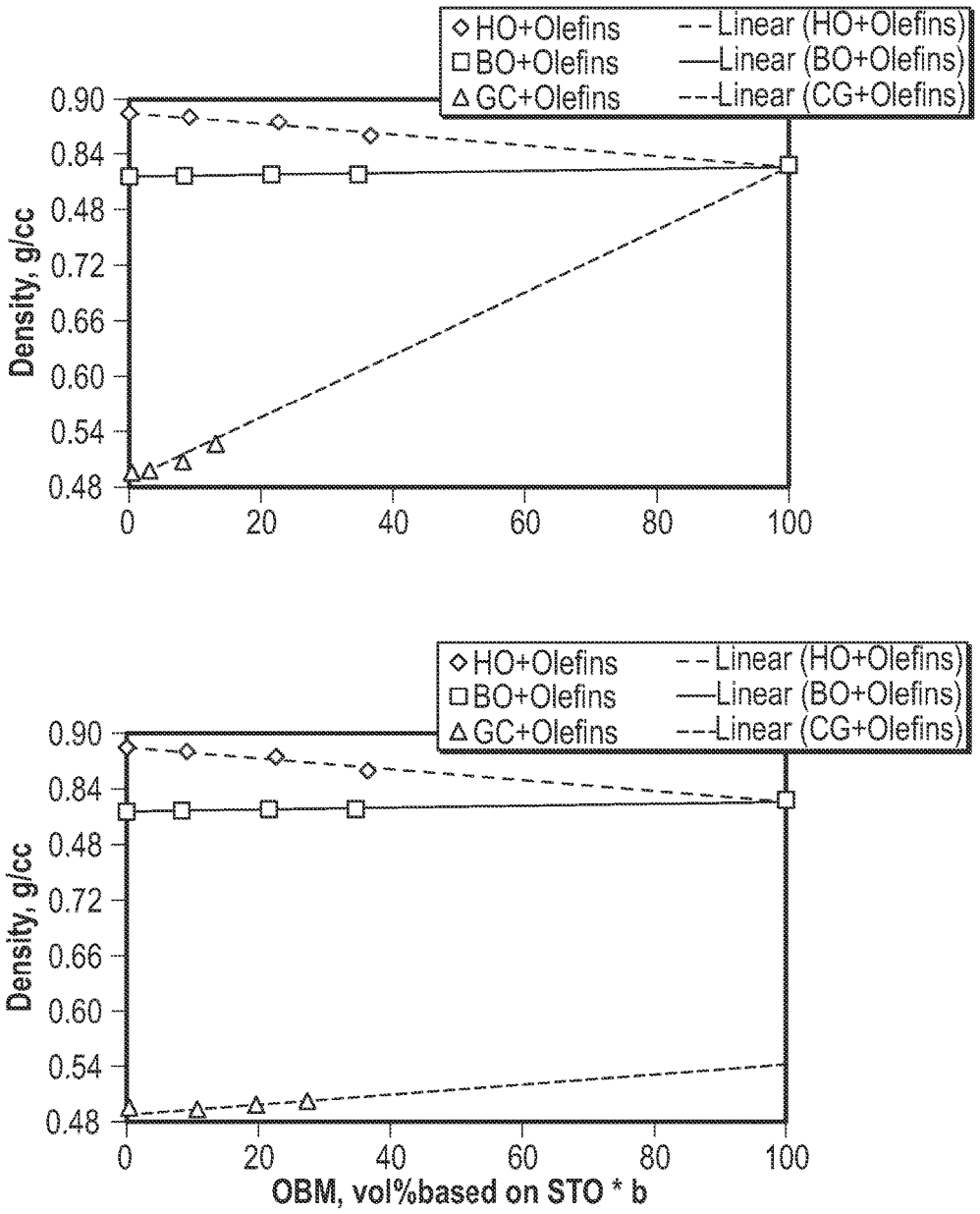
FIG. 3 is a graph of laboratory data for density versus $v_{obm}$ and a graph of laboratory data for density versus $v_{obmSTO}$.

FIG. 3A is a graph of laboratory data for density versus $v_{obm}$ and FIG. 3B is a graph of laboratory data for density versus $v_{obmSTO}$. As illustrated, the density versus $v_{obmSTO}$ and $v_{obm}$ are all linear. The linear relation between density and $v_{obm}$ ($v_{obmSTO}$ converted to the live fluid basis) crosses over the pure OBM filtrate endpoint and the native fluid endpoint ($v_{obm}=0$ and $\rho=\rho_0$). Whereas the linear relation between density and $v_{obmSTO}$ (on the STO basis) does not pass through the pure OBM filtrate endpoint $v_{obmSTO}=0$ and $\rho=\rho_0$, but the native fluid endpoint ($v_{obmSTO}=0$ and $\rho=\rho_0$), in particular for gas condensate (high GOR fluids).

Equalizing Equations 5 and 6 produces Equation 7:

$$b\frac{GOR_0 - GOR}{GOR_0} = \frac{\rho_0 - \rho}{\rho_0 - \rho_{obm}} \quad \text{Equation 7}$$

Figure 4:
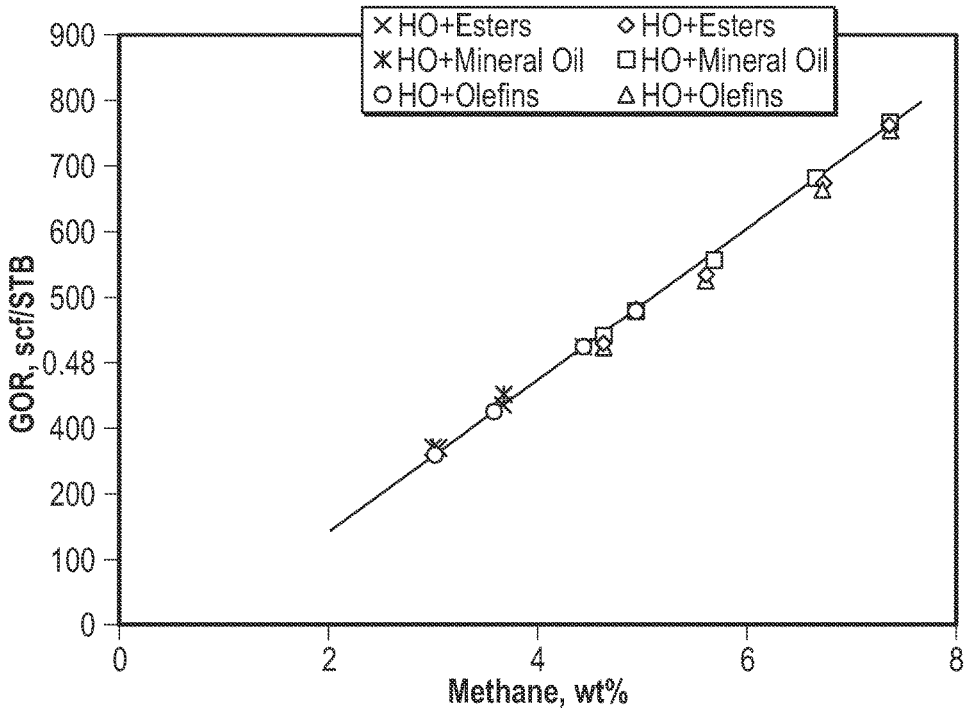
FIG. 4 is a graph of laboratory data for the density versus GOR for a specified fluid and OBM filtrate.
Figure 4:
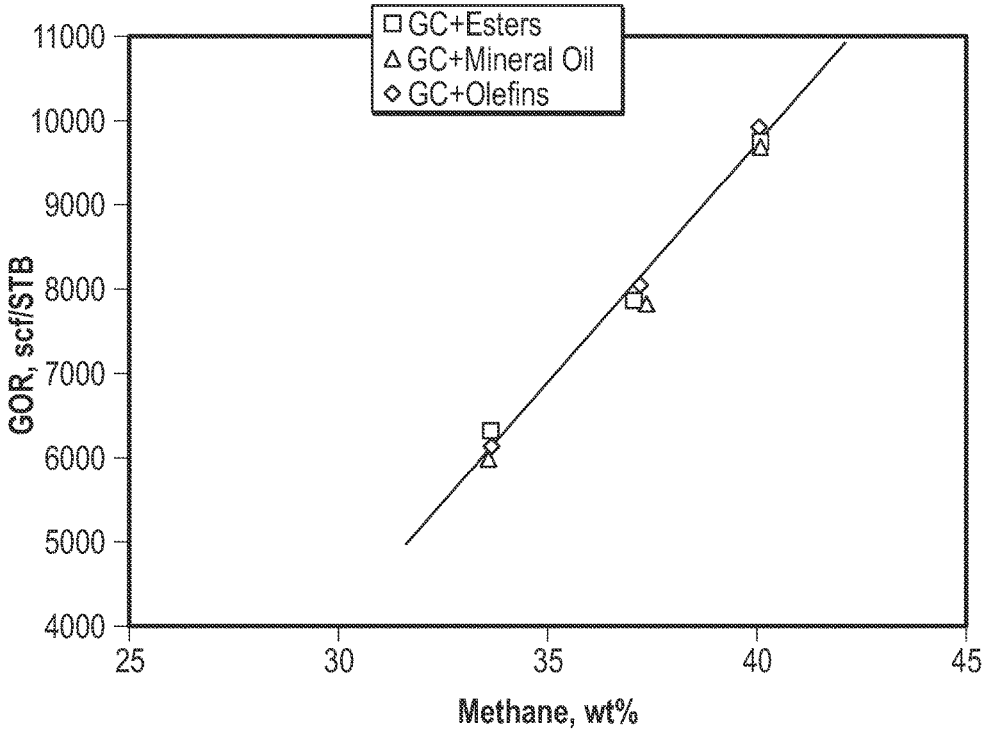

Because $GOR_0$, $\rho_0$ and $\rho_{obm}$ and b are constant for the specified fluid and OBM filtrate, the relation between GOR and density is also linear for the specified fluid and OBM filtrate. FIG. 4 shows the density versus GOR for the specified fluid and OBM filtrate. As provided, the relationship is linear.

The OBM filtrate contamination may be given by optical density at different wavelengths $$v_{obm} = \frac{OD_{0i} - OD_i}{OD_{0i} - OD_{obmi}} \quad \text{Equation 8}$$

where $OD_{0i}$,$OD_i$,$OD_{obmi}$ are the optical density of the native fluid, contaminated fluid (referring to as apparent optical density) and OBM filtrate at channel i. Equalizing Equations 6 and 8 yields Equation 9:

$$\frac{OD_{0i} - OD_i}{OD_{0i} - OD_{obmi}} = \frac{\rho_0 - \rho}{\rho_0 - \rho_{obm}} \quad \text{Equation 9}$$

Therefore the relation between optical density at any channel and mass density is also linear for the specified fluid and OBM filtrate. Similarly, the relationship between optical density and GOR are also linear.

Because downhole gas chromatographs measure reservoir fluid compositions more accurately than optics, the gas chromatograph compositions (mass fraction m) can be used for OCM as well. The oil based mud filtrate contamination in weight fraction is given by the following component mass balance equation:

$$w_{obm} = \frac{m_{0j} - m_j}{m_{0j} - m_{obmj}} \quad \text{Equation 10}$$

where $m_{0j}$,$m_j$,$m_{obmj}$ are the mass fraction of the native fluid, contaminated fluid (referred to as apparent composition) and OBM filtrate from component j. Therefore, the compositions (mass fractions) for different components are linear as well. The value $m_{obmj}$ can be measured by gas chromatograph for the base oil or OBM filtrate, especially for light components (e.g., lighter than heptanes; $m_{obmj}$=0) they are equal to zero. The value $m_j$ is measured by downhole gas chromatograph. The single unknown is $m_{0j}$ which may be fitted by a power function asymptote as done for other fluid properties mentioned previously.

Converting OBM filtrate contamination in weight fraction to volume fraction, the following is obtained:

$$\begin{aligned} v_{obm} &= \frac{w_{obm}\rho}{\rho_{obm}} \\ &= \frac{\rho}{\rho_{obm}} \frac{m_{0j} - m_j}{m_{0j} - m_{obmj}} \\ &= r\frac{m_{oj} - m_j}{m_{oj} - m_{obmj}} \end{aligned} \quad \text{Equation 11}$$

The density ratio ($r=\rho/\rho_{obm}$) is approximately considered as constant. Equalizing equations 5 and 11 results in equation 12.

$$b\frac{GOR_0 - GOR}{GOR_0} = r\frac{m_{0j} - m_j}{m_{0j} - m_{obmj}} \quad \text{Equation 12}$$

Therefore, because b and r are approximately constant, GOR is in line with component mass fraction. FIG. 4 shows the laboratory data between GOR and methane weight percent for heavy oil+OBM, black oil+OBM and gas condensate+OBM systems. The laboratory data show that the values are linearly related.

From the above derivations, linear relations are followed between any pair of GOR, mass density, optical density at any channel, and mass fractions. Hence, these relations can be used for consistent and quality check of the downhole fluid analysis acquisition data.

In general, in order to obtain the endpoint of the native reservoir fluid, GOR, density, optical density and mass fraction are fitted by the following power functions:

$$GOR=GOR_0-\beta_1 v^{-\gamma} \quad \text{Equation 13}$$

$$\rho=\rho_0-\beta_2 V^{-\gamma} \quad \text{Equation 14}$$

$$OD_1=OD_{0i}-\beta_{3i}V^{-\gamma} \quad \text{Equation 15}$$

$$m_j=m_{oj}-\beta_{4j}V^{-\gamma} \quad \text{Equation 16}$$

where GOR, ρ, $OD_i$, $m_j$ and V are the apparent gas/oil ratio, density, optical density at channel i, mass fraction for component j and pumpout volume (can be replaced by time t), measured by downhole fluid analysis, $GOR_0$,$\rho_0$,$OD_{Oi}$, $m_{oj}$,$\beta_1$,$\beta_2$,$\beta_{3i}$,$\beta_{4j}$ and γ are the adjustable parameters. Once good data regression is obtained for GOR, density, optical density and component mass fraction $GOR_0$,$\rho_0$,$OD_{Oi}$,$m_{oj}$ for the native fluid (endpoint) can be extrapolated by assuming that the pumpout volume (or time) approaches infinity so that uncontaminated (native) fluid properties such as GOR, density, OD and component mass fraction are obtained. It should noticed that γ should be identical in Equations 13 to 16 because the linear relationship between any pair of GOR, ρ, $OD_i$ and $m_j$ should be linearly proportional to $V^{-\gamma}$.

In one or more embodiments, GOR, ρ, $OD_i$ and $m_j$ may be fitted by exponential functions.

$$GOR=GOR_0-\beta_1 e^{-\gamma V} \quad \text{Equation 17}$$

$$\rho=\rho_0-\beta_2 e^{-\gamma V} \quad \text{Equation 18}$$

$$OD_i=OD_{oi}-\beta_{3i}e^{-\gamma V} \quad \text{Equation 15}$$

$$m_j=m_{oj}-\beta_{3j}e^{-\gamma} \quad \text{Equation 16}$$

V can be replaced by time (t). In this case, γ should be identical as well in Equations (17) and (20).

The optimized γ value using all the downhole fluid analysis measured GOR, ρ. $OD_i$ and $m_j$ data vs pumpout volume (or time), and then more reliable uncontaminated reservoir fluid GOR, mass density, optical density and component mass fraction (decontamination), and the OBM filtrate contamination level.

In one example embodiment, apparent mass density, OD and component mass fraction measured by downhole fluid analysis during cleanup are related to GOR by:

$$GOR(\rho)=\alpha\rho+b \quad \text{Equation 21}$$

$$GOR(OD_i)=c_i OD_i+d_i \quad \text{Equation 22}$$

$$GOR(m_j)=e_j m_j+f_j \quad \text{Equation 23}$$

where a, b, $c_i$, $d_i$, $e_j$ and $f_i$ are coefficients which are determined from DFA measurements. The downhole fluid analysis measured apparent GOR, the GOR(ρ), GOR ($OD_i$) and GOR($m_j$) calculated by equations 21 to 23 together with pumpout volume (or time). The GOR data is then fit, using Equation 13 or Equation 17 to obtain $GOR_0$ and exponent γ. The values $\rho_0$, $OD_0$, and $m_{oj}$ are obtained using Equations 21 to 23 from the obtained $GOR_0$ or mass density is fit, optical density and component mass fraction data using the obtained exponent γ from GOR fitting.

Figure 5:
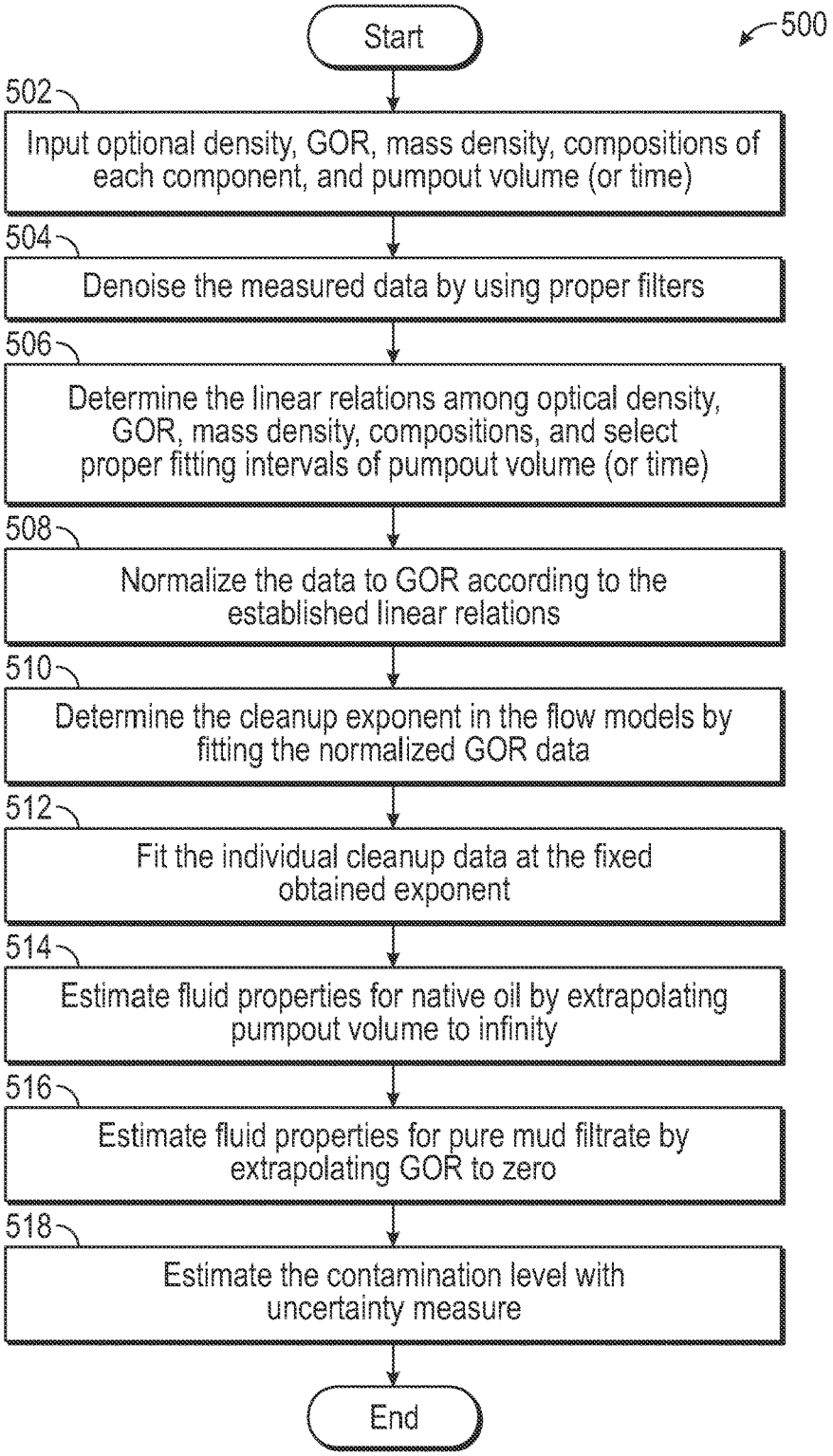
FIG. 5 is a method for fitting in oil based mud filtrate contamination monitoring from multiple downhole sensors.

Referring to FIG. 5, a method 500 for fitting in oil based mud filtrate contamination monitoring from multiple downhole sensors is provided. In 502, optical density is input at multiple channels, GOR, mass density, compositions of each component and pumpout volume (or time). In 504, the measured data may be denoised by using proper filters. One example filter is a Kalman filter. In 506, the linear relations among optical density, GOR, mass density and compositions is determined. A proper fitting interval for pumpout volume (or time) is selected. In 508, the data is normalized to GOR. Such normalization may be accomplished using equations 21 to 23. In 510, the cleanup exponent in the flow models is determined by fitting the normalized GOR data. In 512, the individual cleanup data is fit at the fixed obtained exponent. At 514, fluid properties are estimated by extrapolating pumpout volume to infinity. Such fluid properties as optical density, mass density, GOR, and compositions for native oil are estimated. At 516, fluid properties are estimated for pure OBM filtrate by extrapolating GOR to zero. Fluid properties such as optical density, mass density may be estimated. At 518, the OBM filtrate contamination level is estimated with an uncertainty measure.

In one non-limiting embodiment a method for contamination monitoring is provided comprising measuring data of an optical density, GOR, mass density, composition of at least two components and one of a pumpout volume and a pumpout time at a downhole location, determining linear relationships among the measured data for optical density, GOR, mass density and the composition of the at least two components, selecting a fitting interval of one of pumpout volume and pumpout time, normalizing the measured data, determining a cleanup exponent in a flow model by fitting the normalized GOR data, obtaining a plot of data by fitting the individual cleanup data at a fixed obtained exponent, estimating fluid properties for optical density, mass density, GOR and composition for native oil by extrapolating the pumpout volume to infinity for the plot of data, estimating fluid properties for optical density, mass density, GOR and composition for pure OBM filtrate by extrapolating GOR to zero for the plot of data, and estimating an OBM filtrate contamination level.

The method may also be accomplished wherein at least one of the measured data is obtained through a downhole gas chromatograph.

The method may also be accomplished wherein the fitting is performed by an asymptote.

The method may also be accomplished wherein the asymptote is a power function asymptote.

The method may also be accomplished such that it further comprises denoising the measured data before the determining a linear relationship between optical density, GOR, mass density and the composition of the at least two components.

The method may also be accomplished wherein the denoising is performed through a Kalman filter, as a non-limiting embodiment.

The method may also be accomplished wherein the estimating the fluid properties for optical density, mass density, GOR and composition for native oil by extrapolating the pumpout volume to infinity for the plot of data is performed on a straight line relationship from the plot of data.

The method may also be accomplished wherein the estimating fluid properties for optical density, mass density, GOR and composition for pure OBM filtrate by extrapolating GOR to zero for the plot of data is performed on a straight line relationship from the plot of data.

The method may also be accomplished wherein the estimating the OBM filtrate contamination level is done by a formula:

$$v_{obm} = r\frac{m_{oj} - m_j}{m_{oj} - m_{obmj}}.$$

While the aspects have been described with respect to a limited number of embodiments, those skilled in the art, having benefit of the disclosure, will appreciate that other embodiments can be devised which do not depart from the scope of the disclosure herein.

What is claimed is:

1. A method for contamination monitoring, comprising:

measuring via a downhole sensor disposed in a wellbore data of an optical density, GOR, mass density, composition of at least two components and one of a pumpout volume and a pumpout time at a downhole location;

determining a linear relationship between at least two of optical density, GOR, mass density and the composition of the at least two components;

selecting a fitting interval of one of pumpout volume and pumpout time;

normalizing the measured data;

determining a cleanup exponent in a flow model by fitting the normalized GOR data;

obtaining a plot of data by fitting the individual cleanup data at a fixed obtained exponent;

estimating fluid properties for optical density, mass density, GOR and composition for native oil by extrapolating the pumpout volume to infinity for the plot of data;

estimating fluid properties for optical density, mass density, GOR and composition for pure OBM filtrate by extrapolating GOR to zero for the plot of data; and estimating an OBM filtrate contamination level.

2. The method according to claim 1, wherein at least one of the measured data is obtained through a downhole gas chromatograph.

3. The method according to claim 1, wherein the fitting is performed by an asymptote.

4. The method according to claim 3, wherein the asymptote is a power function asymptote.

5. The method according to claim 1, further comprising:

denoising the measured data before the determining a linear relationship between optical density, GOR, mass density and the composition of the at least two components.

6. The method according to claim 5, wherein the denoising is performed through a Kalman filter.

7. The method according to claim 1, wherein the estimating the fluid properties for optical density, mass density, GOR and composition for native oil by extrapolating the pumpout volume to infinity for the plot of data is performed on a straight line relationship from the plot of data.

8. The method according to claim 1, wherein the estimating fluid properties for optical density, mass density, GOR and composition for pure OBM filtrate by extrapolating GOR to zero for the plot of data is performed on a straight line relationship from the plot of data.

9. The method according to claim 1, wherein the estimating the OBM filtrate contamination level is done by a formula:

$$v_{obm} = r\frac{m_{oj} - m_j}{m_{oj} - m_{obmj}}$$

where $v_{obm}$ is a volume of pure OBM filtrate, r is a density ratio of a fluid density to an OBM filtrate density, $m_{oj}$ is a mass fraction of a native fluid, $m_j$ is a mass fraction of a contaminated fluid, and $m_{obmj}$ is a mass fraction of OBM filtrate from component j.

* * * * *